US005120631A

United States Patent [19]

Kanbayashi et al.

[11] Patent Number: 5,120,631

[45] Date of Patent: Jun. 9, 1992

[54] COLOR TONER

[75] Inventors: Makoto Kanbayashi; Kenji Okado; Takayuki Nagatsuka; Yoshinobu Baba, all of Yokohama, Japan

[73] Assignee: Canon Kabushiki Kaisha, Tokyo, Japan

[21] Appl. No.: 514,232

[22] Filed: Apr. 25, 1990

[30] Foreign Application Priority Data

Apr. 25, 1989 [JP] Japan ..... 1-103485

[51] Int. Cl.[5] ..... G03G 9/00

[52] U.S. Cl. ..... 430/106; 430/110; 430/111

[58] Field of Search ..... 430/109, 110, 111, 106, 430/137

[56] References Cited

U.S. PATENT DOCUMENTS 4,904,558 2/1990 Nagatsuka et al. ..... 430/110
4,980,254 12/1990 Hiro ..... 430/135 X

FOREIGN PATENT DOCUMENTS 1-154161 6/1989 Japan ..... 430/106

*Primary Examiner*—Marion E. McCamish
*Assistant Examiner*—Stephen Crossan
*Attorney, Agent, or Firm*—Fitzpatrick, Cella, Harper & Scinto

[57] ABSTRACT

A color toner, comprises non-magnetic resin particles containing a coloring agent and two types of inorganic oxide particles, wherein;

particles of coloring agent have an average particle diameter D of 300 mμ≦D≦800 mμ as determined by measurement of scattered-light intensity; coloring agent particles with a particle diameter of from (D−120) mμ to (D+120) mμ account for not less than 90% of the whole; coloring agent particles with a particle diameter of 169 mμ or less account for not more than 1.0%; and coloring agent particles with a particle diameter of 949 mμ or more account for not more than 0.5%;

said color toner has a volume average diameter of from 6 to 10 μm; colored resin particles with a particle diameter of 5 μm or less are contained in a proportion of from 15 to 40% by number; colored resin particles with a particle diameter of from 12.7 to 16.0 μm are contained in an amount of from 0.1 to 5.0% by volume; colored resin particles with a particle diameter of 16 μm or more are contained in an amount of not more than 1.0% by volume; and colored resin particles with a particle diameter of from 6.35 to 10.1 μm have a particle size distribution that satisfies the following expression:

$$9 \leqq V \times \bar{d}v/N \leqq 14$$

wherein V represent a volume percentage of colored resin particles with a diameter of from 6.35 to 10.1 μm; N represents a number percentage of colored resin particles with a diameter of from 6.35 to 10.1 μm; and $\bar{d}v$ represents a volume average particle diameter of the whole colored resin particles; and said inorganic oxide particles comprise a hydrophobic inorganic oxide (A) having an absolute value of not less than 50 μc/g for the amount of triboelectricity and a specific surface area $S_A$ of from 80 to 300 $m^2/g$ as measured by the BET method, contained in an amount of a% by weight based on the colored resin particles, and a hydrophilic inorganic oxide (B) having an absolute value of not more than 20 μc/g for the amount of triboelectricity and a specific surface area $S_B$ of from 30 to 200 $m^2/g$ as measured by the BET method, contained in an amount of b% by weight based on the colored resin particles, where $S_A \geqq S_B$, a≧b, and 0.3≦a+b≦1.5.

21 Claims, 2 Drawing Sheets

COLOR TONER

BACKGROUND OF THE INVENTION

Field of the Invention and Related Art

The present invention relates to a color toner used for converting an electrostatic latent image to a visible image in an image forming process such as electrophotography or electrostatic recording.

In recent years, with wide spread of image forming apparatus such as color copying machines for electrophotography, they have come to be widely used for various purposes and also severely required to satisfy image quality. In the copying of images such as photographs, catalogs or maps in common use, it is demanded for them to be very finely and faithfully reproduced throughout their details without any crushed or broken images.

In image forming apparatus such as color copying machines for electrophotography that recently employ digital image signals, a latent image is formed as a group of dots having a given potential, and a solid area, a half-tone area and a light area are expressed by variation of dot density. There, however, is a problem that the gradation of a toner image, corresponding to the ratio of dot density at a black area to dot density at a white area of a digital image, can not be obtained when toner particles are in such a state that they do not accurately cover the dot and are protruded therefrom. Moreover, when the dot size is made small to improve the resolution so that image quality can be improved, it becomes more difficult to achieve fidelity of reproduction of a latent image formed of minute dots, tending to bring about an image having a poor resolution, in particular, a poor gradation at a highlight area, and lacking in sharpness.

It sometimes occurs that an image has a good image quality in the initial stage but turns out to have a poor image quality in the course of continual copying or printing-out. This phenomenon occurs presumably because only toner particles that have good developability are preferentially consumed in the course of continual copying or printing-out, and toner particles that have poor developability are accumulated and remain in the developing machine.

For the purpose of improving image quality, several developing agents have been hitherto proposed. Japanese Patent Application Laid-Open No. 51-3244 (corresponding to U.S. Pat. No. 3,942,979, No. 3,969,251 and No. 4,112,024) discloses a non-magnetic toner in which particle size distribution is controlled, aiming at an improvement in image quality. This toner mainly comprises a toner with a particle diameter of from 8 to 12 μm, which is relatively coarse. Studies made by the present inventors have revealed that a toner with such particle diameter can not uniformly densely "cover" a latent image. In addition, it has a broad particle size distribution in view of the characteristics that particles with a diameter of 5 μm or less account for not more than 30% by number and those of 20 μm or more account for not more than 5% by number. This tends to lower uniformity. In order to form a sharp image by the use of such a toner containing a coarse toner particles end also having a broad particle size distribution, it is necessary to provide toner particles in a large thickness so that there can be no spaces between particles, thereby increasing apparent image density. This also brings about the problem of an increase in consumption of the toner necessary for attaining a given image density.

Japanese Patent Application Laid-Open No. 54-72054 (corresponding to U.S. Pat. No. 4,284,701) discloses a non-magnetic toner having a sharper distribution than the above toner. However, the size of particles with an intermediate weight is as coarse as from 8.5 to 11.0 μm, and there is a room for further improvement for a color toner capable of faithfully reproducing minute-dot latent images and giving a high resolution.

Japanese Patent Application Laid-Open No. 58-129437 (corresponding to British Patent No. 2,114,310) discloses a non-magnetic toner having an average particle diameter of from 6 to 10 μm and in which the particles present in the greatest number have a diameter of from 5 to 8 μm. Since, however particles of 5 μm or less account for as small as not more than 15% by number, an image lacking in sharpness tends to be formed.

As a result of studies made by the present inventors, it has been found that toner particles with a diameter of 5 μm or less can definitely reproduce minute dots of latent images and have the principal function that a toner can densely cover the whole latent images. In particular, in the case of an electrostatic latent image on a photosensitive member, an edge that forms the contour of an image has a higher electric field strength than the inner part thereof because of concentration of lines of electric force, so that the sharpness of an image depends on the quality of the toner particles gathering at the periphery. Studies made by the present inventors have revealed that the amount of toner particles of 5 μm or less is effective for solving the problems in the highlight gradation.

However, a problem may arise such that aggregation force of the toner itself may increase with a decrease in the particle diameter of toner particles and an increase in the toner particles of 5 μm or less, so that the mixing property with a carrier or the fluidity of toner is deteriorated.

For the purpose of improving the fluidity, it has been conventionally attempted to add a fluidity improver. It, however, is difficult to balance the fluidity and charging characteristics of a toner to satisfy the flying of a toner or a high image density, unless the particle size distribution and, in particular, the amount for the presence of coarse particles in the toner particles is taken into account.

Studies made by the present inventors have revealed that use of toner particles of from 12.7 μm to 16.0 μm contained in an amount of from 0.1 to 5.0% by volume, when toner particles of 5 μm or less are contained in a proportion of from 15 to 40% by number, can achieve stable fluidity of a toner and can be effective for solving the problems.

SUMMARY OF THE INVENTION

An object of the present invention is to provide a color toner that has solved the problems as discussed above.

Another object of the present invention is to provide a color toner that can achieve a high image density and a superior fine-line reproduction and highlight gradation.

Still another object of the present invention is to provide a color toner that may not cause any change in performance after use for a long period of time.

A further object of the present invention is to provide a color toner that may not cause any change in performance against environmental changes.

A still further object of the present invention is to provide a color toner having a superior transfer performance.

A still further object of the present invention is to provide a color toner capable of giving a high image density with a small consumption.

A still further object of the present invention is to provide a color toner that can attain a superior resolution, highlight gradation and fine-line reproduction even in an apparatus for forming an image according to digital image signals.

A still further object of the present invention is to provide a color toner suitably used in a two-component developer.

The present invention provides a color toner for developing an electrostatic latent image, comprising non-magnetic colored resin particles containing a coloring agent, and at least two types of inorganic oxide particles, wherein;

particles of said coloring agent have an average particle diameter D of 300 mμ≦D≦800 mμ as determined by measurement of scattered-light intensity coloring agent particles with a particle diameter of from (D−120) mμ to (D+120) mμ account for not less than 90% of the whole; coloring agent particles with a particle diameter of 169 mμ or less account for not more than 1.0%; and coloring agent particles with a particle diameter of 949 mμ or more account for not more than 0.5%;

said color toner has a volume average diameter of from 6 to 10 μm; colored resin particles with a particle diameter of 5 μm or less are contained in a proportion of from 15 to 40% by number; colored resin particles with a particle diameter of from 12.7 to 16.0 μm are contained in an amount of from 0.1 to 5.0% by volume; colored resin particles with a particle diameter of 16 μm or more are contained in an amount of not more than 1.0% by volume; and colored resin particles with a particle diameter of from 6.35 to 10.1 μm have a particle size distribution that satisfies the following expression:

$$9 \leqq V \times \bar{d}v/N \leqq 14$$

wherein V represents a volume percentage (% by volume) of colored resin particles with a particle diameter of from 6.35 to 19.1 μm; N represents a number percentage (% by number) of colored resin particles with a particle diameter of from 6.35 to 10.1 μm; and dv represents a volume average particle diameter of the whole colored resin particles; and said inorganic oxide particles comprise a hydrophobic inorganic oxide (A) having an absolute value of not less than 50 μc/g for the amount of triboelectricity and a specific surface area $S_A$ of from 80 to 300 $m^2/g$ as measured by the BET method, contained in an amount of a % by weight based on the colored resin particles, and a hydrophilic inorganic oxide (B) having an absolute value of not more than 20 μc/g for the amount of triboelectricity and a specific surface area $S_B$ of from 30 to 200 $m^2/g$ as measured by the BET method, contained in an amount of b % by weight based on the colored resin particles, where $S_A \geqq S_b$, $a \geqq b$, and $0.3 \leqq a+b \leqq 1.5$.

DETAILED DESCRIPTION OF THE PREFERRED EMBODIMENTS

Figure 1:
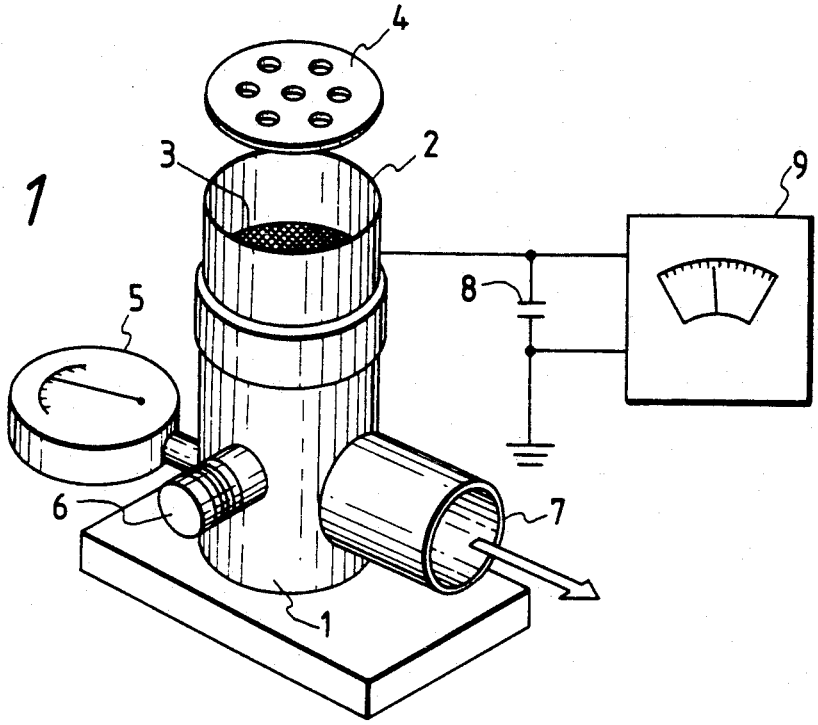
FIG. 1 illustrates an apparatus for measuring the amount of triboelectricity.

The color toner of the present invention that employs a coloring agent having a specific particle size distribution, contains at least two types of inorganic oxide particles and has the particle size distribution as described above, enables faithful reproduction of latent images formed on a photosensitive member. It also can achieve a superior reproduction of minute-dot latent images such as halftone images and digital images, and particularly give a superior gradation and resolution at a highlight.

In the color toner containing the coloring agent having the particle size distribution as described above, the coloring agent is dispersed in a resin in a good state and hence the toner can have a greatly increased coloring power. In addition, the color toner has a higher transparency with an improvement in dispersion properties of the coloring agent, thus giving an image with a superior overhead projection transparency for OHP. Uniform dispersion of the coloring agent in a resin results in a toner having a stable amount of triboelectricity, and promises a constant image density and a high-grade image free from fog.

Moreover, with the color toner of the present invention, it is possible to maintain a high image quality even after continual copying or printing-out, and also carry out good development in a smaller toner consumption than that in conventional non-magnetic toners even in case of obtaining a toner image with high density. Thus, the present invention is advantageous in that copying or printing can be economical and the body of a copying machine or printer can be made small in scale.

The reason why such effect can be obtained in the color toner of the present invention is not necessarily clear, but can be presumed as follows.

In the resin particles containing the coloring agent having the particle size distribution as previously described, a characteristic feature resides in that particles of the coloring agent have an average particle diameter D of 300 mμ≦D≦800 mμ, coloring agent particles with a particle diameter of from (D−120) mμ to (D+120) mμ account for not less than 90% of the whole, coloring agent particles with a particle diameter of 169 mμ or less account for not more than 1.0%, and coloring agent particles with a particle diameter of 949 mμ or more account for not more than 0.5%.

As previously described, a low-triboelectric hydrophilic inorganic oxide and a hydrophobic inorganic oxide are used in combination in the resin particles containing the coloring agent having the particle size distribution according to the present invention, whereby the fluidity of the toner can be improved and an image can be made to have a high quality.

Nevertheless, even if color toner particles (or colored resin particles) have contributed to faithful development for a latent image on a photosensitive member, the resulting image may have a poor quality if the coloring power of color toner particles themselves is inferior, and the fixed toner can not attain satisfactory transparency if the coloring agent is not well dispersed and present in the state of agglomerates. As a result, no satisfactory results can be obtained when the toner is mixed with a toner of different tone for the purpose of color mixture.

In addition, in order to obtain a fog-free, highly dense and highly detailed color image, it is also indispensable for the coloring agent to be uniformly dispersed in color toner particles (in other words, for the coloring agent particles to be dispersed in a resin in a fine, uniform and stable state as far as possible).

However, whether or not a coloring agent can be well dispersed mostly depends on the form, size, surface state, chemical structure, polarity, charge or the like according to conditions in the manufacture of a coloring agent. Even in coloring agents prepared under the same conditions, different results can be produced depending on what type of resins are used, what type of additives are used, whether or not additives are used, and a difference in dispersing methods. Thus, it is considerably difficult in the present situation to imagine whether or not a coloring agent can be well dispersed.

In addition, polyester resins are nowadays widely used as binder resins for color toners in view of light transmission properties, color mixture properties and offset resistance. In dispersing a coloring agent in a low-melting resin such as a sharp-melting linear polyester, no sufficient shearing force can be applied with ease at the time of dispersing it. Thus, it is impossible in the present situation to achieve satisfactory dispersion.

For these reasons, there are great expectations on theoretical systematization and practical application of the theoretical system, in regard to the dispersion of a pigment. A number of studies have been made in the present field of research.

In general, the size and particle size distribution of particles of a coloring agent greatly participate in the dispersibility of the agent. The finer its particle diameter is, the better state of dispersion can be obtained with ease. However, in the step of dispersing a coloring agent, it is complicatedly concurrent that the coloring agent and a resin are wetted (or made compatible with each other), particles are made finer, and coloring agent particles are re-aggregated or stabilized. A certain stable state is kept by the mutual balance between these. Hence, a coloring agent with an excessively small particle diameter may cause re-aggregation of coloring agent particles to unbalance the system, resulting in no good state of dispersion. On the other hand, a coloring agent with an excessively large particle diameter not only makes it impossible to achieve uniform dispersion, but also requires an enormous mechanical energy in the step of its dispersion.

In the present invention, as a result of studies made on the particle diameter and dispersibility of coloring agents, on the basis of the above findings, the average particle diameter and particle size distribution of a coloring agent used are concurrently defined, so that it is made possible to achieve good dispersion of a coloring agent and to provide a color toner having a high coloring power and superior light transmission properties.

Specifically, the average particle diameter D of the coloring agent used is defined to be 300 mμ≦D ≦800 mμ, so that dispersion is achieved in a good state. A coloring agent with an average particle diameter of D<300 mμ can be readily uniformly dispersed in a resin, to be sure, but on the other hand may cause re-aggregation between particles of the coloring agent with an increase in the surface free energy because of an increase in the surface areas, tending to produce firm aggregates. The aggregates thus formed can not be re-dispersed with ease. Thus, a coloring agent with an excessively small particle diameter makes it impossible to attain a stable dispersion system. When a coloring agent of D<300 mμ is actually dispersed in a resin, a microphotographic observation can reveal that large aggregates are not completely dispersed in the resin and are present as they stand.

On the other hand, when the particle diameter D is excessively large, it is necessary to forcedly bring a coloring agent into contact with a dispersion medium so that a good state of dispersion can be obtained. This imposes considerable restrictions on the type of a dispersion mixer or its drive conditions. However, in dispersing a coloring agent of D>800 mμ, the compatibility of resin with coloring agent is so poor even with use of a strong dispersing mixer that the coloring agent can not be made finer beyond the level expected by us.

The average particle diameter D of a coloring agent used should preferably be in the range of from 350 mμ to 700 mμ, and more preferably from 400 mμ to 600 mμ. A coloring agent having an average particle diameter within the above range can be dispersed in a polyester resin in a good state by mechanical dispersion using a low energy.

In the present invention, the average particle diameter of a coloring agent used is defined as described above to achieve an improvement in dispersion properties. According to further studies made on the particle size distribution of a coloring agent, toners can have a uniform coloring power when a coloring agent has a uniform particle diameter, i.e. a sharp particle size distribution, so that the amount of electrostatic charge can be always stable also in triboelectric charging with a carrier. Good results can be obtained when coloring agent particles with a particle diameter of from (D−120) mμ to (D+120) mμ account for not less than 90% of the whole, coloring agent particles with a particle diameter of 169 mμ or less account for not more than 1.0%, and coloring agent particles with a particle diameter of 949 mμ0 or more account for not more than 0.5%. When the coloring agent particles with a particle diameter of 169 mμ or less are present in a proportion more than 1.0%, aggregation of the coloring agent may proceed because of the coloring agent having such a small particle diameter, resulting in the incorporation of even the coloring agent having the particle diameter within the range of from (D−120) mμ to (D+120) mμ to form large aggregates. In usual instances, a melt kneader can not give an energy large enough to disintegrate coarse particles of 949 mμ or more, resultingly making it impossible to disperse particles in a medium in a fine, uniform and stable state.

In the present invention, the particle diameters of coloring agents have been measured by various measuring means so that studies are made on the relationship between the particle diameter and the dispersion in resins. As a result, it has been found that, although the particle diameter actually measured on the basis of an electron micrograph (×20,000) certainly coincides with values of physical properties of a coloring agent and is useful for the measurement of a primary particle diameter, what is more important in discussing its dispersion in a resin is the particle diameter measured in the state that some particles have gathered (i.e., in the state of quasi-primary particles or secondary particles), and it is indeed indispensable for the achievement of good dispersion to define such a particle diameter. Hence, a Coulter counter, which measures scattered-light intensity, is used in measuring the particle diameter of the coloring agent, and thus a toner with a high coloring power has been designed on the basis of the resulting particle diameter (which is larger by the factor of approximately one order than what is obtained from the electron micrograph).

As a measuring apparatus, Submicron Particle Analyzer N4SD (manufactured by Coulter Electronics Inc.) is used. Measurement is carried out in the following way: In a 50 cc beaker, 30 ml of distilled water and from 0.1 to 1 ml of a surface active agent, preferably an alkylbenzene sulfonate, as a dispersant are added, and a sample for measurement is added in a small amount, using a microspatula. A suspension in which the sample has been suspended is dispersed for 2 to 5 minutes using an ultrasonic generator (manufactured by Tomii Seiko K.K.). Several ml of the resulting dispersion is put in a cell of 1 cm in light-path length, and particle size distribution is measured using the above Coulter counter N4SD to determine the value according to the present invention.

Another characteristic feature in the color toner of the present invention is that color toner particles with a particle diameter of 5 μm or less are contained in a proportion of from 15 to 40% by number. In conventional color toners, it has been believed to be difficult to control the charging amount of electrostatic charge in the color toner particles of 5 μm or less, or to be necessary to positively decrease such color toner particles as they are components that impair the fluidity of a color toner or contaminate a machine because of the flying of color toner, and also as components that cause fog of a color toner image.

However, the studies made by the present inventors have revealed that color toner particles of about 5 μm can be a component essential for the formation of an image with a high quality.

For example, using a two-component developer containing a non-magnetic toner having a particle size distribution ranging from 0.5 μm to 30 μm and a carrier, latent images were developed, which were made to have a varied latent image potential on a photosensitive member by changing surface potential on the photosensitive member so that they range from a latent image having a development potential large enough for a number of toner particles to readily contribute development, to a latent image of halftone, and further to a latent image formed of minute dots small enough for only a very small number of toner particles to contribute development. Toner particles on the photosensitive member, having contributed to the development, were collected, and toner particle were many non-magnetic toner particles of 8 μm or less, in particular, non-magnetic toner particles of about 5 μm, on the minute-dot latent image. An image faithful to a latent image can be formed when the non-magnetic toner particles with a particle diameter of about 5 μm are smoothly fed for the development of a latent image on a photosensitive member, and thus an image having a really superior fidelity of reproduction can be obtained without protrusion from the latent image.

In the color toner of the present invention, still another characteristic feature is that particles with a particle diameter of from 12.7 to 16.0 μm are contained in an amount of from 0.1 to 5.0% by volume.

This feature is concerned with the necessity of the presence of the above non-magnetic toner particles with a particle diameter of about 5 μm. Although the non-magnetic toner particles with a particle diameter of 5 μm or less certainly have a power to faithfully reproduce a latent image of fine dots, but have considerably high aggregating properties, so that the fluidity required for a non-magnetic toner may sometimes be damaged.

For the purpose of improving fluidity, the present inventors have attempted to improve fluidity by adding the two types of inorganic oxide particles previously described. However, it was confirmed that the conditions that can satisfy all the items of image density, flying of toner, and fog are very narrow if only the means of adding the inorganic oxide particles is taken. Hence, the present inventors made further studies on the particle size distribution of a toner. As a result, they have reached a finding that the non-magnetic toner particles with a particle diameter of 5 μm or less may be contained in a proportion of from 15 to 40% by number and, in addition, toner particles with a particle diameter of from 12.7 to 16.0 μm may be contained in an amount of from 0.1 to 5.0% by volume, whereby the problem of fluidity can be solved and also an image can be made to have a higher quality. It is presumed that the toner particles in the range of from 12.7 to 16.0 μm give an appropriately controlled fluidity to the non-magnetic toner particles of 5 μm or less, so that a sharp image with high density and superior resolution and gradation can be provided even after continual copying or printing-out.

A further characteristic feature of the color toner of the present invention is that toner particles with a particle diameter of from 6.35 to 10.1 μm satisfy the following relationship between the volume percentage (V), number percentage (N) and volume average particle diameter (dv):

$$9 \leqq V \times \bar{d}v/N \leqq 14 \ (6\ \mu m \leqq \bar{d}v \leqq 10\ \mu m)$$

In the course of studies on the state of particle size distribution and the development characteristics, the present inventors have found that there is a state of the presence of particle size distribution most suited for achieving the object, as represented by the above expression.

When the particle size distribution is controlled by commonly available air classification, a large value in the above relationship is construed to indicate an increase in the toner particles of about 5 μm capable of faithfully reproducing a minute-dot latent image, and a small value in the above relationship, to reversely indicate a decrease in the toner particles of about 5 μm.

Thus, a good fluidity of a toner and a faithful latent image reproduction can be achieved when the $\bar{d}v$ is in the range of from 6 to 10 μm and at the same time the above relationship is satisfied.

Toner particles with a particle diameter of 16 μm or more are contained in an amount of not more than 1.0% by volume, which are preferred when contained in an amount as smaller as possible.

The constitution of the present invention will be described below in greater detail. Non-magnetic toner particles with a particle diameter of 5 μm or less should be desirably contained in a proportion of from 15 to 40% by number, and preferably from 20 to 35% by number, of the whole. A proportion less than 15% by number, of the non-magnetic toner particles with a particle diameter of 5 μm or less results in less non-magnetic toner particles effective for obtaining a high image quality. In particular, it results in a decrease in the component of effective non-magnetic toner particles as a toner is consumed as a result of continual copying and printing-out, bringing about a poor balance of the particle size distribution of non-magnetic toner particles, described in the present invention, and also a gradual lowering of image quality. On the other hand, a proportion more than 40% by number tends to cause a state of aggregation between non-magnetic toner particles to form toner lumps having a particle diameter larger than the original one, resulting in a rough image, and a lowering of resolution. It may also result in a great difference in density between the edge and inner part of a latent image, tending to give an image with a touch of hollow characters.

Particles with a particle diameter in the range of from 12.7 to 16.0 μm should be desirably contained in an amount of from 0.1 to 5.0% by volume, and preferably from 0.2 to 3.0% by volume. An amount more than 5.0% by volume may result in a poor image quality and at the same time cause an excessive development, i.e., over-covering of a toner. On the other hand, an amount less than 0.1% by volume may result in a lowering of image density because of a lowering of fluidity.

Non-magnetic toner particles with a particle diameter of 16 μm or more should be desirably contained in an amount of not more than 1.0% by volume, and more preferably not more than 0.6% by volume. An amount more than 1.0% by volume not only may bring about obstruction to the fine-line reproduction, but also may result in projection of a little coarse particles of 16 μm or more to the surface of a thin-layer of toner particles formed by development on a photosensitive member, so that the delicate state of adhesion between the photosensitive member and a transfer paper through the toner layer becomes irregular to cause variations of transfer conditions. This can be a cause of production of a faulty transferred image.

The non-magnetic toner has a volume average particle diameter of from 6 to 10 μm, and preferably from 7 to 9 μm. This value can not be taken to be separate from the respective constituent factors described above. A volume average particle diameter less than 6 μm may result in a smaller amount of the toner covering a transfer paper, in the use that requires a high image area ratio as in a graphic image, tending to bring about the problem of low image density. This is presumed to be caused by the same reason as that for the phenomenon that the inner part of a latent image has a lower density than the edge thereof as previously described. A volume average particle diameter more than 10 μm can bring about no good resolution, so that the image quality, even though it can be good at the beginning, tends to be lowered in the course of continual use.

Particle size distribution of a toner can be measured by various methods. In the present invention, it is measured using a Coulter counter.

Using a Coulter counter Type TA-II (manufactured by Coulter Electronics Inc.) as a measuring apparatus, an interface (manufactured by Nikkaki K.K.) which Outputs number distribution and volume distribution and a personal computer CX-1 (manufactured by Canon Inc.) are connected thereto. As an electrolytic solution, an aqueous 1% NaCl solution is prepared using first-grade sodium chloride. Measurement is carried out in the following way: In from 100 to 150 ml of the above aqueous electrolytic solution, from 0.1 to 5 ml of a surface active agent, preferably an alkylbenzene sulfonate, as a dispersant are added, and a sample for measurement is further added in an amount of from 2 to 20 mg. The electrolytic solution in which the sample has been suspended is dispersed for about 1 to about 3 minutes using an ultrasonic dispersion machine. Using the above Coulter counter Type TA-II and also using a 100 μm aperture as an aperture, particle size distribution of particles with a particle diameter of from 2 to 40 μm is measured on the basis of the number so that the value which is in accordance with the present invention is determined.

In the present invention, a characteristic feature also resides in that the inorganic oxide particles comprise a hydrophobic inorganic oxide (A) having an absolute value of not less than 50 μc/g for the amount of triboelectricity and a specific surface area $S_A$ of from 80 to 300 $m^2/g$ as measured by the BET method, contained in an amount of a % by weight based on the colored resin particles containing the coloring agent having the above particle size distribution, and a hydrophilic inorganic oxide (B) having an absolute value of not more than 20 μc/g for the amount of triboelectricity and a specific surface area $S_B$ of from 30 to 200 $m^2/g$ as measured by the BET method, contained in an amount of b % by weight based on the colored resin particles, where $S_A \geqq S_B$, $a \geqq b$, and $0.3 \leqq a+b \leqq 1.5$.

As previously described, use of the toner having the particle size distribution according to the present invention can achieve faithful development by toner with respect to the latent image formed of minute dots, and may cause less non-uniformity in the adhesion of toner at the edge of a latent image.

However, when a toner has been made to have a smaller particle diameter, the Coulomb force or van der Waals force exerted to the toner becomes relatively stronger than the gravity or inertial force. Hence, the attraction between toner particles becomes stronger, tending to produce toner aggregates. As measures against it, the hydrophilic, low-triboelectric inorganic oxide having an absolute value of not more than 20 μc/g for the amount of triboelectricity can weaken the attraction resulting from electrostatic charge to make it hard for the toner aggregates to be produced. When a toner has been made to have a smaller particle diameter, contact points between a toner and a carrier increase, and thus the carrier tends to be spent with ease. As measures against it also, the low-triboelectric inorganic oxide can act as a good spacer between a carrier and a toner, bringing about good results.

When a toner has been made to have a smaller particle diameter, the toner tends to be electrostatically charged in excess. The addition of the hydrophilic, low-triboelectric inorganic oxide can also solve this problem.

As described above, the hydrophilic inorganic oxide is very effective for preventing aggregation of toner particles or suppressing excessive electrostatic charge. For the reason as will be stated below, this component is required to have the stated specific surface area in the range of from 30 $m^2/g$ (about 40 mμ) to 200 $m^2/g$ (about 12 mμ), and may preferably be in the range of from 80 $m^2/g$ (about 25 mμ) to 150 $m^2/g$ (about 15 mμ).

For example, an inorganic oxide having a BET specific surface area greater than 200 $m^2/g$ can bring about a sufficient fluidity, but on the other hand may give a toner susceptible to deterioration because of its hydrophilic nature. The deterioration takes place as a phenomenon in which the amount of electrostatic charge greatly changes or the fluidity of a developer becomes poor, when copies are taken in succession in the state that a toner is consumed in a small amount.

A low-triboelectric inorganic oxide having a BET specific surface area smaller than 30 $m^2/g$ makes it difficult to obtain a sufficient fluidity even when used in combination with other fluidity-providing agents. It also tends to bring about insufficient dispersion of the fluidity-providing agents, resulting in generation of fog in an image.

Even when the above inorganic oxide has a BET specific surface area in the range of from 30 to 200 $m^2/g$, an ill effect may be given unless it is used in combination with the hydrophobic silica. When the low-triboelectric inorganic oxide has a BET specific surface area in the range of from 30 to 100 $m^2/g$, its sole use may result in an insufficient fluidity, and hence it is required to be used in combination of the hydrophobic silica, which has a high effect of providing fluidity. When it has a BET specific surface area in the range of from 100 to 200 $m^2/g$, the surfaces of the fine particles containing a coloring agent is uniformly covered with the fine, low-triboelectric inorganic oxide, so that the sole use of the low-triboelectric inorganic oxide may result in an excessive decrease in the amount of electrostatic charge. Hence, it is required to be used in combination with the hydrophobic silica, which is negatively chargeable.

As in the above, the hydrophobic silica can supplement the low-triboelectric inorganic oxide on account of the negative chargeability and the fluidity-providing ability. Hence, no sufficient action can be obtained unless the BET specific surface area thereof is not less than 80 $m^2/g$. It may preferably be not less than 150 $m^2/g$.

The fluidity of a toner can be more improved when the low-triboelectric inorganic oxide and the hydrophobic inorganic oxide particles are used in combination than when they are each used alone. Thus the mixing of a developer can be more readily carried out and also the toner cleaning or the like can be more improved.

In order to make the present invention more effective, a specific surface area $S_A$ of the hydrophobic inorganic oxide (A) and a specific surface area $S_B$ of the hydrophilic inorganic oxide (B) must be $$S_A \geqq S_B,$$

and the components (A) and (B) must be contained in amounts of a % by weight and b % by weight, respectively, based on the resin particles containing a coloring agent, so as to satisfy the following expression:

$$a \geqq b, \text{ and } 0.3 \leqq a+b \leqq 1.5.$$

If $a<b$, or the $a+b$ does not satisfy the above condition, it becomes difficult to balance electrostatic chargeability and fluidity.

If $(a+b)>1.5$, fixing performance required for a toner may be lowered, particularly resulting in a lowering of overhead projection transparency.

As the hydrophobic inorganic oxide used in the present invention, a negatively chargeable inorganic oxide having a specific surface area of not less than 80 $m^2/g$ and an absolute value of not less than 50 $\mu c/g$ for the amount of triboelectricity is used. As an example, it is preferred to use a treated silica fine powder, obtained by hydrophobic treatment of a silica fine powder produced by gaseous phase oxidation of a silicon halogenide. In the treated silica fine powder, particularly preferred is the one obtained by treating the silica fine powder so that the degree of hydrophilicity as measured by methanol titration is a value ranging from 30 to 80.

The silica fine powder can be made hydrophobic by chemical treatment using an organic silicon compound capable of reacting with, or being physically adsorbed on, the silica fine powder.

As a preferred method, the silica fine powder produced by gaseous phase oxidation of a silicon halogenide is treated with an organic silicon compound.

Examples of such an organic silicon compound are hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, a triorganosilylmercaptan, trimethylsilylmercaptan, a triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each one Si in the unit positioned at a terminal. These may be used alone or as a mixture of two or more kinds.

It is preferred to use a treated silica fine powder having a particle diameter in the range of from 0 003 to 0.1 μm. Commercially available silica fine powder includes Tullanox-500 (available from Tulco Co. Inc.) and AEROSIL R-972 (Japan Aerosil Co.).

On the other hand, the hydrophilic inorganic oxide may preferably include alumina and titanium oxide, which can be relatively readily made to have a sharp particle size by a gaseous phase process. There are no particular limitations on preparation methods and crystal structure. However, those having an extremely angular particle shape or an acicular particle shape are not preferred.

As the coloring agent suited for the objects of the present invention, any known dyes and pigments can be used as long as the above average particle diameter and particle size distribution can be satisfied, which are exemplified by copper phthalocyanine pigments, azo pigments, bisazo yellow pigments, anthraquinone pigments, quinacridone pigments, bisazo oil-soluble dyes. Of these, organic pigments are preferred.

For the purpose of increasing the affinity of the coloring agent for a resin, the coloring agent may have been subjected to some surface treatment.

Particularly preferred pigments are C.I. Pigment Yellow 17, C.I. Pigment Yellow 1, C.I. Pigment Yellow 12, C.I. Pigment Yellow 13, C.I. Pigment Yellow 14, C.I. Pigment Red 5, C.I. Pigment Red 2, C.I. Pigment Red 3, C.I. Pigment Red 17 C.I. Pigment Red 22, C.I. Pigment Red 23, C.I. Pigment Red 122, C.I. Pigment Blue 15, C.I. Pigment Blue 16, a phthalocyanine pigment represented by the following structural formula (I), and a copper phthalocyanine pigment represented by the following structural formula (II), which is a barium (Ba) salt comprising a phthalocyanine skeleton substituted with 2 or 3 carboxybanzamidomethyl.

(I)

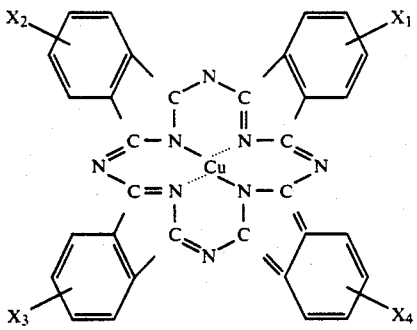

In the formula, $X_1$ to $X_4$ each represent

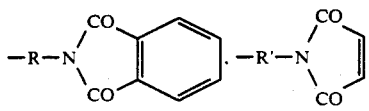

or a hydrogen atom, where R and R' each represents an alkylene group having 1 to 5 carbon atoms, provided that all of $X_1$ to $X_4$ are not hydrogen atoms at the same time.

(II)

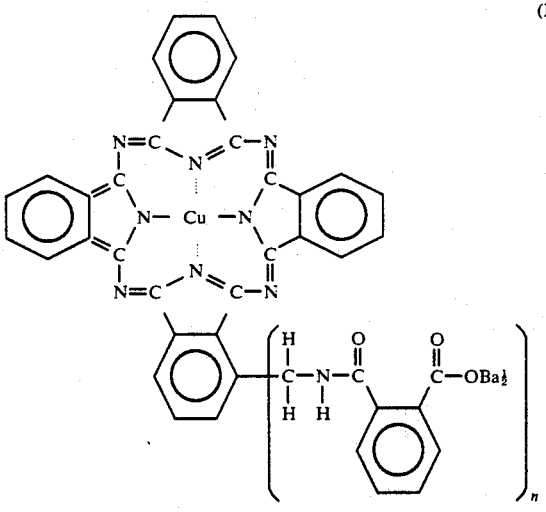

In the formula, n represents 2 to 3.

The dyes include C.I. Solvent Red 49, C.I. Solvent Red 52 and C.I. Solvent Red 109.

The above coloring agent may preferably be contained in an amount of not more than 8 parts by weight, and more preferably from 0.5 to 6 parts by weight, based on 100 parts by weight of a binder resin. This applies to a yellow toner, which sensitively reflects the transparency of an OHP film.

An amount more than 8 parts by weight may result in a poor reproduction of green, which is a mixed color of yellow, and red, or flesh color of a human being as for an image.

In regard to other magenta and Cyan color toners, the coloring agent may preferably be contained in an amount of not more than 10 parts by weight, and more preferably from 0.1 to 8 parts by weight, based on 100 parts by weight of a binder resin.

Particularly in regard to a black toner, in which coloring agents corresponding to two or more colors are used in combination, their addition in an amount of not less than 15 parts by weight in total of the coloring agents not only tends to be spent in a carrier but also results in melt-adhesion of a toner to a drum or an increase in the uncertainty of fixing performance. Hence, the coloring agents may be in an amount of from 3 to 10 parts by weight based on 100 parts by weight of a binder resin.

Combination of preferred coloring agents for the formation of the black toner includes a combination of a bisazo yellow pigment, a monoazo red pigment and a copper phthalocyanine blue pigment. These pigments may preferably be mixed in a proportion of 1:1.5 to 2.5:0.5 to 1.5 in the ratios between the yellow pigment, the red pigment and the blue pigment, respectively.

As a binder material used in the colored resin particles containing the coloring agent of the present invention, various material resins conventionally known as binder resins of toners for electrophotography are used.

For example, they include polystyrene, styrene copolymers such as a styrene/butadiene copolymer and a styrene/acrylate copolymer, polyethylene, ethylene copolymers such as an ethylene/vinyl acetate copolymer and an ethylene/vinyl alcohol copolymer, phenol resins, epoxy resins, acrylphthalate resins, polyamide resins, polyester resins, and maleic acid resins. For all of these resins, there are no particular limitations on the method of preparing them.

Of these resins, the effect of the present invention can be greatest when polyester resins, having a particularly high negative chargeability, are used. The polyester resins have superior fixing performance and hence suited for color toners, but, on the other hand, have so strong negative chargeability that the electrostatic charge tends to be excessive. This disadvantage, however, can be eliminated and a superior toner can be obtained, when the polyester resins are employed in the constitution of the present invention.

In particular, a polyester resin is more preferred which is obtained by co-polycondensation polymerization of a carboxylic acid component comprising a carboxylic acid having two or more valencies, an acid anhydride thereof or a lower alkyl ester thereof (for example, fumaric acid, maleic acid, maleic anhydride, phthalic acid, terephthalic acid, trimellitic acid, or pyromellitic acid), using as a diol component a bisphenol derivative, or a substituted compound thereof, represented by the following formula:

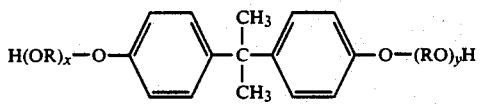

wherein R is an ethylene group or a propylene group, x and y are each an integer of 1 or more, and an average value of x+y is 2 to 10. This polyester resin has sharp melting characteristics.

In particular, in view of light transmission properties for overhead projection transparency, the apparent viscosity at 90° C. may be from $5\times10^4$ to $5\times10^6$ poise, preferably from $7.5\times10^4$ to $2\times10^6$ poise, and more preferably from $10^5$ to $10^6$ poise, and the apparent viscosity at 100° C. may be from $10^4$ to $5\times10^5$ poise, preferably from $10^4$ to $3\times10^5$ poise, and more preferably from $10^4$ to $2\times10^5$ poise. Color OHP with good light transmission properties can be thus obtained and, as a full-color toner, good results can be obtained for fixing property, color-mixing property and high-temperature offset resistance. It is particularly preferred that an absolute value of the difference between an apparent viscosity $P_1$ at 90° C. and an apparent viscosity $P_2$ at 100° C. is in the range of $2\times10^5<|P_1-P_2|<4\times10^6$.

In the color toner according to the present invention, a charge controlling agent may be mixed so that charge characteristics can be stabilized. It is preferred to use a colorless or pale-colored charge controlling agent that may not affect the tone of a color toner. The present invention can be more effective when the color toner is a negatively chargeable color toner. A negative-charge controlling agent used in such an instance includes, for example, an organic metal complex such as a metal complex of an alkyl-substituted salicylic acid as exemplified by a chromium complex or zino complex of di-tert-butylsalicylic acid. When the negative-charge controlling agent is mixed in the toner, it should be added in an amount of from 0.1 to 10 parts by weight, and preferably from 0.5 to 8 parts by weight, based on 100 parts by weight of the binder resin.

When a two-component developer is prepared, magnetic particles used in combination with the color toner of the present invention include, for example, a metal such as iron, nickel, copper, zinc, cobalt, manganese, chromium and rare earth elements, alloys or oxides thereof, and ferrite, which are surface-oxidized or unoxidized. There are no particular limitations on the method of preparing the magnetic particles.

In combination with the color toner of the present invention, the surfaces of the above magnetic particles may preferably be coated with resins or the like. As methods therefor, it is possible to use conventional methods such as a method in which a coating material such as resin is dissolved or suspended in a solvent and the resulting solution is applied so that the resin is adhered to the magnetic particles, and a method in which powders are merely mixed. In order to stabilize a coating, the method in which a coating material is dissolved in a solvent is more preferred.

Materials to be coated on the surfaces of the above magnetic particles may vary depending on toner materials, preferable materials include, for example, aminoacrylate resins, acrylic resins, or copolymers of any of these resins with styrene resins, silicone resins, polyester resins, polytetrafluoroethylene, monochlorotrifluoroethylene polymers, and polyvinylidene fluoride. The materials are not necessarily limited to these.

What are most suited for the combination with the color toner of the present invention are acrylic resins, or copolymers of acrylic resins with styrene resins.

Materials most suited as materials for the magnetic particles used in the present invention are ferrite particles composed of 98% or more of Cu-Zn-Fe with a compositional ratio of (5 to 20):(5 to 20):(30 to 80), which can be readily surface-smoothed, have a stable charge-providing power, and can stabilize a coat.

The above compounds may be coated in an amount appropriately determined so that charge-providing characteristics of magnetic particles can satisfy the conditions previously described. In general, they may be used in a total amount of from 0.1 to 30% by weight, and preferably from 0.3 to 20% by weight, based on the magnetic particles used in the present invention.

These magnetic particles may preferably have a weight average particle diameter of from 35 to 65 μm, and more preferably from 40 to 60 μm. A good developed image can be maintained when particles with a particle diameter of 26 μm or less in weight distribution is contained in an amount of from 2 to 6% by weight; those of from 35 μm to 43 μm in weight distribution, from 5 to 25% by weight; and those of 74 μm or more, not more than 2% by weight.

In the present invention, the above magnetic particles and the color toner may be in such a mixing proportion that the concentration of the color toner in a developer is from 2.0% by weight to 9% by weight, and preferably from 3% by weight to 8% by weight. Good results can be thus obtained. A concentration less than 2.0% by weight, of the color toner may make image density too low to be of practical use. A concentration more than 9% by weight may bring about an increase in fog or in-machine flying, resulting in a short lifetime of the two-component developer.

In the present invention, it is also possible to further use additives. They include a lubricant as exemplified by aliphatic acid metal salts such as zinc stearate and aluminum stearate, and fine particles of fluorine-containing polymers such as fine particles of polytetrafluoroethylene, polyvinylidene fluoride, or a polytetrafluoroethylene/polyvinylidene fluoride copolymers.

An abrasive such as cerium oxide or silicon carbide, or a conductivity-providing agent such as tin oxide or zinc oxide may further be added.

In preparing the colored resin particles containing the coloring agent according to the present invention, a thermoplastic resin, which may be optional, a pigment or dye as the coloring agent, the charge controlling agent and other additives are thoroughly mixed using a mixing machine such as a ball mill, and the resulting mixture is melted, kneaded and milled using a heat mixing machine such as a heat roll, a kneader or an extruder so that resins are made compatible with each other. In the resulting mixture, the pigment or dye is thus dispersed or dissolved, and the resulting dispersion is cooled, solidified, and then pulverized, followed by exact classification. The colored resin particles containing the coloring agent according to the present invention can be thus obtained.

Measuring methods concerning characteristic values of the toner used in the present invention will be described below.

(1) Measurement of amount of triboelectricity:

FIG. 1 illustrates an apparatus for measuring the amount of triboelectricity. First, a mixture of particles to be set to measurement and magnetic particles used in the two-component developer is prepared. They are mixed in such a proportion that, in the case of the toner or the colored resin particles containing a coloring agent, the former particles are in an amount of 1 part by weight based on 9 parts by weight of the magnetic particles, and, in the case of the inorganic oxide particles, in an amount of 2 parts by weight based on 98 parts by weight of the magnetic particles.

The toner or inorganic oxide particles and the magnetic particles to be set to measurement are placed in a measurement environment, and left to stand for 12 hours or more, which are thereafter put in a 50 to 100 ml bottle made of polyethylene, followed by thorough mixing and stirring (60 time reciprocating mixing).

Next, about 0.5 to about 1.5 g of the mixture of the magnetic particles and the toner or inorganic oxide particles to be set to measurement of the amount of triboelectricity is put in a measuring container 2 made of a metal, provided on its bottom with a 500 mesh conductive screen 3 (mesh size can be appropriately changed to a size in which no magnetic particles pass through), and then the container is covered with a lid 4 made of a metal. Here, the weight of the whole measuring container 2 is represented by $W_1$(g). Next, in a suction machine 1 (at least the part coming into contact with the measuring container 2 comprises an insulating material), particles are sucked from a suction pipe 7, and the pressure of a vacuum gauge is set to be 250 mmAq by controlling a air-flow control valve 6. Suction is thoroughly carried out (for about 2 minutes) in this state. The toner or inorganic oxide particles are thus removed by suction. Here, the potential of a potentiometer 9 is represented by V. Here, the numeral 8 denotes a capacitor, and its capacity is represented by C(μF). The whole measuring container through which the particles have been sucked is weighed, and the weight is represented by $W_2$(g). The amount of triboelectricity T (μC/g) is calculated according to the following equation:

$$\text{Amount of triboelectricity T } (\mu C/g) \text{ of sample} = C \times V / W_1 - W_2$$

provided that measurement is made under conditions of 23° C., 60% RH.

(2) Measurement of particle size distribution:

Using a Coulter counter Type TA-11 (manufactured by Coulter Electronics Inc.) as a measuring apparatus, an interface (manufactured by Nikkaki K.K.) which outputs number distribution and volume distribution and a personal computer CX-1 (manufactured by Canon Inc.) are connected thereto. As an electrolytic solution, an aqueous 1% NaCl solution is prepared using first-grade sodium chloride.

Measurement is carried out in the following way: In from 100 to 150 ml of the above aqueous electrolytic solution, from 0.1 to 5 ml of a surface active agent, preferably an alkylbenzene sulfonate, as a dispersant are added, and a sample for measurement is further added in an amount of from 0.5 to 50 mg.

The electrolytic solution in which the sample has been suspended is dispersed for about 1 to about 3 minutes using an ultrasonic dispersion machine. Using the above Coulter counter Type TA-II and also using a 100 μm aperture as an aperture, particle size distribution of particles with a particle diameter of from 2 to 40 μm is measured so that the volume average distribution and number average distribution are determined.

EXAMPLES

The present invention will be described below in greater detail by giving Examples and with reference to the drawings. In the following, "%" and "part(s)" indicate % by weight and part(s) by weight, respectively.

EXAMPLE 1

Polyester resin obtained by condensation of propoxy-introduced bisphenol with fumaric acid: 100 parts Phthalocyanine pigment: 5 parts Average particle diameter: 428 μm 308 mμ to 548 mμ particles: 90.2%

169 mμ or less particles: 0%

949 mμ or more particles: 0.3%

Chromium complex salt of di-tert-butylsalicylic acid: 4 parts

The above materials were thoroughly mixed using a Henschel mixer. Thereafter, the mixture was melt-kneaded three times using a three-roll mill. The kneaded product was cooled, and then crushed into particles with a particle diameter of about 1 to about 2 mm using a hammer mill. Then, the coarse particles were finely ground using a fine grinding mill. The finely ground products thus obtained were classified using a multi-divided classifier to give cyan resin particles containing the phthalocyanine pigment, in which a volume average diameter was 8.3 μm, particles with a particle diameter of 5 μm or less were contained in a proportion of 25% by number, particles with a particle diameter of from 12.7 to 16.0 μm were contained in an amount of 16% by volume, particles with a particle diameter of 16 μm or more were contained in an amount of substantially 0% by volume, and $V \times \bar{d}v/N$ was $67 \times 8.3/46 = 12.1$.

In 100 parts of the above colored resin particles containing the coloring agent, 0.3 part of an alumina fine powder with an amount of triboelectricity of −3 μc/g, having a specific surface area of 100 $m^2/g$ as measured by the BET method, and 0.5 part of a silica fine powder with an amount of triboelectricity of −80 μc/g, having a specific surface area of 250 $m^2/g$ as measured by the BET method and having been subjected to hydrophobic treatment using hexamethyldisilazane, were externally added together to give a cyan toner.

In 6 parts of the resulting cyan toner, 94 parts of ferrite particles of a Cu-Zn-Fe type (volume average particle diameter: 50 μm) whose particle surfaces were coated with a styrene/acrylic acid/2-ethylhexyl methacrylate copolymer were mixed to give a two-component developer.

Using this two-component developer and setting a commercially available plain-paper full-color laser copying machine (CLC-I; manufactured by Canon Inc.) to have a sleeve peripheral speed of 280 mm/sec, running tests for 30,000 sheets were carried out in environments of ordinary temperature and ordinary humidity (23° C., 60% RH), low temperature and low humidity (15° C., 10% RH) and high temperature and high humidity (32.5° C., 85% RH). As a result, images with a sufficient image density and a high image quality were obtained in all the environments.

Figure 2:
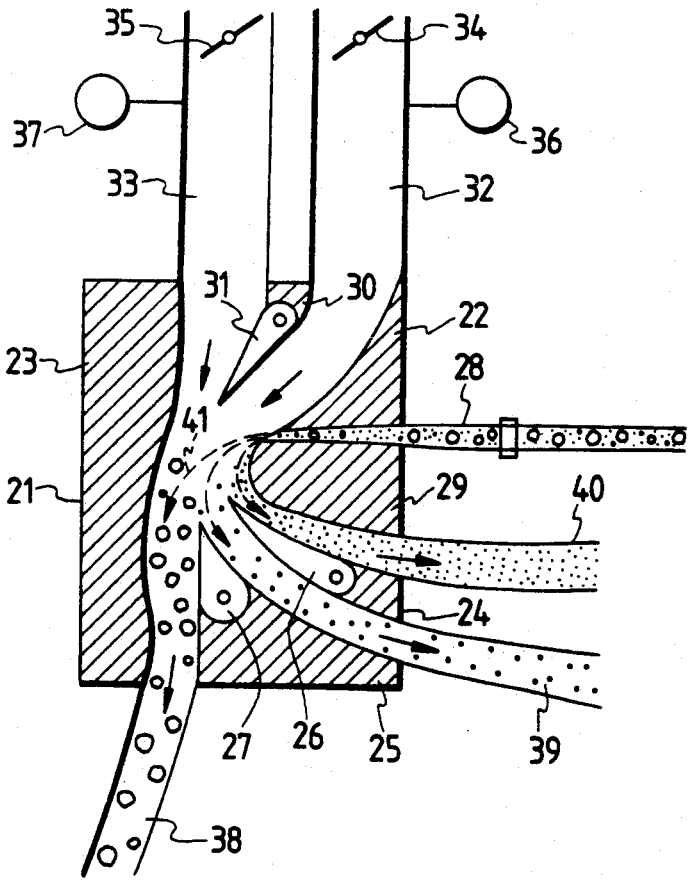
FIG. 2 is a view to illustrate a classification process in which a multi-divided classifying means is used.
Figure 3:
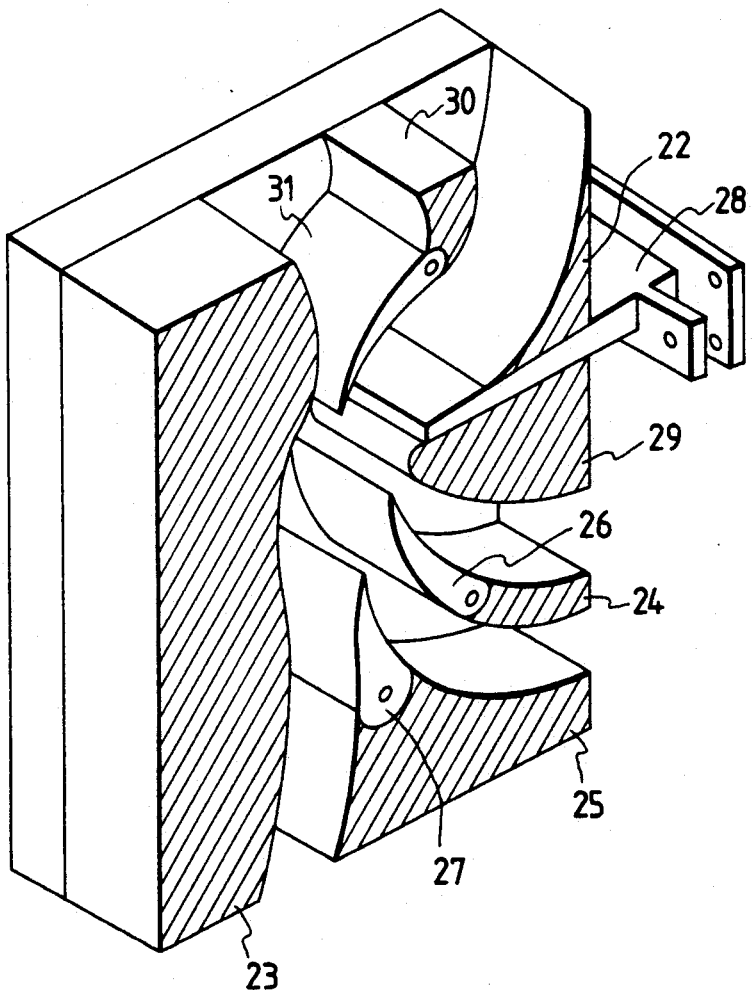
FIG. 3 is a perspective view to schematically illustrate a cross-section of the multi-divided classifying means.

The multi-division classifier used in the present Example and the classification process carried out using the classifier will be described here with reference to FIGS. 2 and 3. In a multi-division classifier 1 as illustrated in FIGS. 2 and 3, side walls have the shapes as indicated by the numerals 22 and 24 and a lower wall has the shape as denoted by the numeral 25. The side wall 23 and the lower wall 25 are provided with knife edge-shaped classifying wedges 26 and 27, respectively, and these classifying wedges 26 and 27 separate the classifying zone into three divisions. A material feed nozzle 28 opening into the classifying chamber is provided at the lower part of the side wall 22. A Coanda block 29 is disposed along an extension of the lower tangential line of the nozzle 28 so as to form a long elliptic arc that curves downward. The classifying chamber has an upper wall 30 provided with a knife edge-shaped air-intake wedge 31 extending downward, and further provided above the classifying chamber with air-intake pipes 32 and 33 opening into the classifying chamber. The air-intake pipes 32 and 33 are respectively provided with a first gas feed control means 34 and a second gas feed control means 35, respectively, comprising, e.g. a damper, and also provided with static pressure gauges 36 and 37. At the bottom of the classifying chamber, discharge pipes 38, 39 and 40 opening into the chamber are provided corresponding to the respective divisions. The powder to be classified is fed from the feed nozzle 28 to the classifying zone under reduced pressure, and is moved with a curve 41 by the action attributable to the Coanda effect of the Coanda block 29 and the action of high-speed air concurrently flowed in. The powder is thus classified into coarse powder, colored resin particles having a given volume average particle diameter and particle size distribution and ultrafine powder.

COMPARATIVE EXAMPLE 1

Example 1 was repeated to prepare the following colored resin particles containing the coloring agent, except for the use of a copper phthalocyanine pigment having an average particle diameter D=980 mμ.

Volume average diameter: 8.24 μm
5 μm or less particles: 29.8% by number
12.7 to 16.0 μm particles: 1.2% by volume
16 μm or more particles: substantially 0% by volume
$V \times \bar{d}v/N$:62×8.24/41=12.5.

The above colored resin particles containing the coloring agent was heat-melted on a hot plate. The product was observed with a microscope to confirm that some aggregates of pigment remained not completely well dispersed in the resin.

In the same manner as in Example 1, the components were externally added to give a toner and images were produced. As a result, although no great difference was seen in respect of the value of triboelectricity, the image density obtained under conditions of low temperature and low humidity was only from 1.25 to 1.35. Thus, this was a cyan toner having a poor coloring power compared with the toner of Example 1.

COMPARATIVE EXAMPLE 2

Example 1 was repeated to prepare colored resin particles containing a coloring agent, except that the copper phthalocyanine as used in Comparative Example 1 was used and the pass times of the melt-kneading with the three-roll mill was increased to 5 times to strengthen the kneading. Images were produced in the same manner as in Example 1 to obtain the result that the image density was a little lower than that in Example 1. However, the time taken for the melt-kneading using the three-roll mill was about twice, compared with the time taken in Example 1, resulting in an extreme lowering of operability.

COMPARATIVE EXAMPLE 3

Example 1 was repeated to prepare colored resin particles containing the following coloring agent, except for the use of a copper phthalocyanine pigment having an average particle diameter D=200 mμ.

Volume average diameter: 8.18 μm
5 μm or less particles: 30.2% by number
12.7 to 16.0 μm particles: 1.3% by volume
16 μm or more particles: substantially 0% by volume
$V \times \bar{d}v/N$:60.5×8.18/39.8=12.4.

The above colored resin particles containing the coloring agent was heat-melted. The product was observed with a microscope. As a result, in spite of use of the sufficiently fine coloring agent, large aggregates of the pigment were observed. The size of an aggregate reached as large as 5 μm on the photograph.

EXAMPLE 2

Example 1 was repeated to prepare the following magenta resin particles, except for using as a coloring agent 45 parts of C I. Pigment Red 122 (average particle diameter D=501 mμ; D+120 mμ=98%; 169 mμ or less: substantially 0%; 949 mμ or more: substantially 0%)

Volume average diameter: 8.14 μm
5 μm or less particles: 34.7% by number
12.7 to 16.0 μm particles: 0.9% by volume
16 μm or more particles: 0% by volume
$V \times \bar{d}v/N$:66.2×8.14/41.9=12.86.

Images were produced in the same manner as in Example 1. As a result, the image density obtained even under conditions of low temperature and low humidity was as high as from 1.35 to 1.45. and sharp images free from fog were obtained. The transparency of OHP sheets was also very good.

EXAMPLE 3

Example 1 was repeated to prepare the following yellow resin particles, except for using as a coloring agent 3.5 parts of C.I. Pigment Yellow 17 (D=505 mμ; D+120 mμ=94.8%; 169 mμ or less: substantially 0%; 949 mμ or more: substantially 0%)

Volume average diameter: 7.7 μm
5 μm or less particles: 31.0% by number
12.7 to 16.0 μm particles: 0.5% by volume
16 μm or more particles: 0% by volume
$V \times \bar{d}v/N$:65×7.7/42=11.9.

Using the above yellow resin particles, images were produced in the same manner as in Example 1. As a result, good results were obtained.

EXAMPLE 4

Example 1 was repeated to prepare the following cyan resin particles, except for using as a cyan coloring agent different from that in Example 1, 5 parts of C.I. Pigment Blue 15 (average particle diameter D=528 mμ; D+120 mμ=91.3%; 169 mμ or less: 0.2%: 949 mμ or more: 0.4%)

Volume average diameter: 7.90 μm
5 μm or less particles: 33.6% by number
12.7 to 16.0 μm particles: 1.5% by volume
16 μm or more particles: 0% by volume
$V \times \bar{d}v/N$:61.4×7.90/38.6=12.6.

In the above cyan resin particles, 0.4 part of an alumina fine powder (amount of triboelectricity: substantially 0) having a specific surface area of 95 $m^2/g$ as measured by the BET method, and 0.4 part of a silica fine powder (amount of triboelectricity: 90 μc/g) having a specific surface area of 150 $m^2/g$ as measured by the BET method and having been subjected to hydrophobic treatment using dimethyldichlorosilane, were externally added together to give a cyan toner.

In 6 parts of the above toner, 94 parts of ferrite particles (volume average particle diameter: 50 μm) whose particle surfaces were coated with a styrene/acrylic acid copolymer were mixed to give a two-component developer.

Using this two-component developer, images were produced in the same manner as in Example 1. As a result, the same good results as in Example 1 were obtained.

Microscopic observation revealed that the cyan pigment was dispersed in the resin in a good state, and no aggregates of pigment were observed.

COMPARATIVE EXAMPLE 4

Example 4 was repeated to prepare a cyan toner, except for the use of C.I. Pigment Blue 15 (average particle diameter D=580 mμ; D+120 mμ=58.3%, 169 mμ or less: 2.8%; 949 mμ or more: 1.2%). Images were produced in the same way. As a result, the image density obtained under conditions of low temperature and low humidity was as low as from 1.15 to 1.25, and seriously fogged image were obtained.

Toner characteristics obtained in the above Examples and Comparative Examples and various characteristics obtained after tests are shown in Tables 1 and 2, respectively.

TABLE 1

| | Particle size distribution of colored resin particles | | | | | Particle size distribution of coloring agent | | | Hydrophobic inorganic oxide | Hydrophilic inorganic oxide |
|---|---|---|---|---|---|---|---|---|---|---|
| | $\bar{d}v$ μm | ≦5 μm | 12.7 to 16.0 μm | ≧16 μm | $V \times \bar{d}v/N$ μm | D mμ | D ± 120 mμ | ≦169 mμ ≧947 mμ | | |
| Example: | | | | | | | | | | |
| 1 | 8.3 | 25% | 1.6% | 0% | 12.1 | 428 | 90.2% | 0%/0.3% | 250 $m^2/g$ −80 μc/g, 0.5* | 100 $m^2/g$ −3 μc/g, 0.3* |
| 2 | 8.14 | 34.7 | 0.9 | 0 | 12.9 | 501 | 98.0 | 0/0 | 250 $m^2/g$ −80 μc/g, 0.5* | 100 $m^2/g$ −3 μc/g, 0.3* |
| 3 | 7.7 | 31.0 | 0.5 | 0 | 11.9 | 505 | 94.8 | 0/0 | 250 $m^2/g$ −80 μc/g, 0.5* | 100 $m^2/g$ −3 μc/g, 0.3* |
| 4 | 7.9 | 33.6 | 1.5 | 0 | 12.6 | 528 | 91.3 | 0.2/0.4 | 150 $m^2/g$ −90 μc/g, 0.4* | 95 $m^2/g$ 0 μc/g, 0.4* |
| Comparative Example: | | | | | | | | | | |
| 1 | 8.24 | 29.8 | 1.2 | 0 | 12.5 | 980 | — | — | Same as Ex. 1 | Same as Ex. 1 |
| 2 | 8.35 | 35.5 | 2.6 | 0 | 12.8 | Same as Comp. Example 1 | | | Same as Ex. 1 | Same as Ex. 1 |
| 3 | 8.18 | 30.2 | 1.3 | 0 | 12.4 | 200 | — | — | Same as Ex. 1 | Same as Ex. 1 |
| 4 | 8.20 | 37.4 | 2.3 | 0 | 13.2 | 580 | 58.3 | 2.8/1.2 | Same as Ex. 4 | Same as Ex. 4 |

*parts

TABLE 2

| | Amount of triboelectricity (μc/g) | | Image density | | Image characteristics | | | |
|---|---|---|---|---|---|---|---|---|
| | Low temp., low humid. (15° C., 10% RH) | High temp., high humid. (32.5° C., 85% RH) | Low temp., low humid. (15° C., 10% RH) | High temp., high humid. (32.5° C., 85% RH) | Fog | Flying of toner | OHP transparency | Durability |
| Example: | | | | | | | | |
| 1 | −35 | −25 | 1.40 to 1.50 | 1.50 to 1.60 | A | A | A | A |
| 2 | −38 | −26 | 1.35 to 1.45 | 1.50 to 1.60 | A | A | A | A |
| 3 | −40 | −27 | 1.30 to 1.40 | 1.40 to 1.50 | A | A | A | A |
| 4 | −34 | −22 | 1.40 to 1.50 | 1.50 to 1.60 | A | A | A | A |
| Comparative Example: | | | | | | | | |
| 1 | −36 | −25 | 1.25 to 1.35 | 1.45 to 1.55 | B | A | C | L/L Low density |
| 2 | −35 | −24 | 1.45 to 1.55 | 1.55 to 1.65 | A | A | A | A |
| 3 | −36 | −21 | 1.25 to 1.35 | 1.55 to 1.65 | B | B | C | L/L Low density |
| 4 | −34 | −21 | 1.15 to 1.25 | 1.45 to 1.55 | C | B | C | Serious fog |

(A: Excellent; B: Fair; C: Failure)

What is claimed is:

1. A color toner for developing an electrostatic latent image, comprising non-magnetic colored resin particles containing coloring agent particles, and at least two types of inorganic oxide particles residing as an external additive on the surface of the colored resin particles, wherein:

said coloring agent particles have an average particles diameter D of 300 mμ≦D≦800 mμ as determined by measurement of scattered-light intensity; coloring agent particles with a particle diameter of from (D−120) mμ to (D+120) mμ account for not less than 90% of the whole; coloring agent particles with a particle diameter of 169 mμ or less account for not more than 1.0%; and coloring agent particles with a particle diameter of 949 mμ or more account for not more than 0.5%;

said color toner has a volume average diameter of from 6 to 10 μm; colored resin particles with a particle diameter of 5 μm or less are contained in a proportion of from 15 to 40% by number; colored resin particles with a particle diameter of from 12.7 to 16.0 μm are contained in an amount of from 0.1 to 5.0% by volume; colored resin particles with a particle diameter of 16 μm or more are contained in an amount of not more than 1.0% by volume; and colored resin particles with a particle diameter of from 6.35 to 10.1 μm have a particle size distribution that satisfies the following expression:

$$9 \leqq V \times \bar{d}v/N \leqq 14$$

wherein V represents the volume percentage (% by volume) of colored resin particles with a particle diameter of from 6.35 to 10.1 μm; N represents the number percentage (% by number) of colored resin particles with a particle diameter of from 6.35 to 10.1 μm; and $\bar{d}v$ represents the volume average particle diameter of the whole colored resin particles; and said inorganic oxide particles comprise a hydrophobic inorganic oxide (A) having an absolute value of not less than 50 μc/g for the amount of triboelectricity and a specific surface area $S_A$ of from 80 to 300 $m^2/g$ as measured by the BET method, contained in an amount of a % by weight based on the colored resin particles, and a hydrophilic inorganic oxide (B) having an absolute value of not more than 20 $\mu c/g$ for the amount of triboelectricity and a specific surface area $S_B$ of from 30 to 200 $m^2/g$ as measured by the BET method, contained in an amount of b % by weight based on the colored resin particles, where $S_A \geqq S_B$, $a \geqq b$, and $0.3 \leqq a+b \leqq 1.5$.

2. The color toner according to claim 1 wherein said coloring agent has an average particle diameter D of from 350 to 700 m$\mu$.

3. The color toner according to claim 1, wherein said coloring agent has an average particle diameter D of from 400 to 600 m$\mu$.

4. The color toner according to claim 1, wherein said coloring agent comprises an organic pigment selected from the group consisting of a copper phthalocyanine pigment, an azo pigment, a bisazo yellow pigment, an anthraquinone pigment and a quinacridone pigment.

5. The color toner according to claim 1, wherein said non-magnetic colored resin particles contain a yellow coloring agent, and said yellow coloring agent is contained in an amount of from 0.5 to 6 parts by weight based on 100 parts by weight of a binder resin.

6. The color toner according to claim 1, wherein said non-magnetic colored resin particles contain a magenta coloring agent, and said magenta coloring agent is contained in an amount of from 0.1 to 8 parts by weight based on 100 parts by weight of a binder resin.

7. The color toner according to claim 1, wherein said non-magnetic colored resin particles contain a cyan coloring agent, and said cyan coloring agent is contained in an amount of from 0.1 to 8 parts by weight based on 100 parts by weight of a binder resin.

8. The color toner according to claim 1, wherein said non-magnetic colored resin particles contain a bisazo yellow pigment, a monoazo red pigment and a copper phthalocyanine blue pigment.

9. The color toner according to claim 8, wherein said non-magnetic colored resin particles contain the bisazo yellow pigment, the monoazo red pigment and the copper phthalocyanine blue pigment in a weight ratio of 1:1.5 to 2.5:0.5 to 1.5.

10. The color toner according to claim 1, wherein said non-magnetic colored resin particles contain a polyester resin as a binder resin.

11. The color toner according to claim 10, wherein said non-magnetic colored resin particles contain as the binder resin a polyester resin containing a bisphenol derivative or a derivative thereof as a diol component unit.

12. The color toner according to claim 1, wherein said non-magnetic colored resin particles contain a charge controlling agent in an amount of from 0.1 to 10 parts by weight based on 100 parts by weight of a binder resin.

13. The color toner according to claim 1, wherein said non-magnetic colored resin particles contain a charge controlling agent in an amount of from 0.5 to 8 parts by weight based on 100 parts by weight of a binder resin.

14. The color toner according to claim 1, wherein said non-magnetic colored resin particles with a particle diameter of 5 $\mu$m or less are contained in a proportion of from 20 to 35% by number.

15. The color toner according to claim 1, wherein said non-magnetic colored resin particles with a particle diameter of from 12.7 to 16.0 $\mu$m are contained in an amount of from 0.2 to 3.0% by volume.

16. The color toner according to claim 1, wherein said non-magnetic colored resin particles with particle diameter of 16 $\mu$m or more are contained in an amount of not more than 0.6% by volume.

17. The color toner according to claim 1, wherein said non-magnetic colored resin particles has a volume average particle diameter of from 7 to 9 $\mu$m.

18. The color toner according to claim 1, wherein said hydrophobic inorganic oxide (A) comprises a silica fine powder having been subjected to hydrophobic treatment.

19. The color toner according to claim 18, wherein said hydrophobic inorganic oxide (A) comprises a silica fine powder having been subjected to hydrophobic treatment, having a particle diameter of from 0.003 to 0.1 $\mu$m.

20. The color toner according to claim 1, wherein said hydrophilic inorganic oxide (B) has a BET specific surface area of from 80 to 150 $m^2/g$.

21. The color toner according to claim 1, wherein said hydrophilic inorganic oxide (B) comprises alumina or titanium oxide.

* * * * *

UNITED STATES PATENT AND TRADEMARK OFFICE

CERTIFICATE OF CORRECTION

PATENT NO. : 5,120,631

DATED : June 9, 1992

INVENTOR(S) : MAKOTO KANBAYASHI, ET AL.

It is certified that error appears in the above-identified patent and that said Letters Patent is hereby corrected as shown below:

COLUMN 1

Line 63, "a" (second occurrence) should be deleted.
Line 64, "end" should read --and--.

COLUMN 3

Line 26, "intensity" should read --intensity;--.
Line 51, "19.1 μm;" should read --10.1 μm;--.
Line 53, "dv" should read --$\bar{d}$v--.

COLUMN 5

Line 43, "it is complicatedly concurrent" should read --it concurrently requires--.

COLUMN 6

Line 45, "949 mμ0" should read --949 mμ--.
Line 55, "resultingly" should read --consequently--.

COLUMN 7

Line 51, "contribute" should read --contribute to--.
Line 55, "ute" should read --ute to--.
Line 57, "particle were" should read --particle size distribution were measured to reveal that there were--.

--

UNITED STATES PATENT AND TRADEMARK OFFICE

CERTIFICATE OF CORRECTION

PATENT NO. : 5,120,631

DATED : June 9, 1992

INVENTOR(S) : MAKOTO KANBAYASHI, ET AL.

It is certified that error appears in the above-identified patent and that said Letters Patent is hereby corrected as shown below:

COLUMN 8

Line 40, "diameter (dv):" should read --diameter ($\bar{d}$v):--.
Line 64, "smaller" should read --small--.

COLUMN 9

Line 66, "Outputs" should read --outputs--.

COLUMN 12

Line 62, "Red 17 C.I." should read --Red 17, C.I.--.

COLUMN 13

Line 2, "2 or 3 carboxybanzamidomethyl." should read --2 or 3 carboxybenzamidomethyl.--.
Line 66, "Cyan" should read --cyan--.

COLUMN 14

Line 10, "be" should read --preferably be--.

COLUMN 15

Line 21, "zino" should read --zinc--.
Line 49, "als, preferable" should read --als. Preferable--.

COLUMN 16

Line 8, "is" should read --are--.

--

UNITED STATES PATENT AND TRADEMARK OFFICE

CERTIFICATE OF CORRECTION

PATENT NO. : 5,120,631

DATED : June 9, 1992

INVENTOR(S) : MAKOTO KANBAYASHI, ET AL.

It is certified that error appears in the above-identified patent and that said Letters Patent is hereby corrected as shown below:

COLUMN 17

Line 15, "a" should read --an--.

COLUMN 18

Line 17, "16%" should read --1.6%--.

COLUMN 19

Line 28, "was" should read --were--.
Line 57, "the following" should read --a--.

COLUMN 20

Line 27, "D + 120 mμ = 94.8%" should read --D ± 120 mμ = 94.8%--.
Line 44, "D + 120 mμ = 91.3%" should read --D ± 120 mμ = 91.3%--.

COLUMN 21

Line 8, "D + 120 mμ = 58.3%" should read --D ± 120 mμ = 58.3%--.
Line 13, "image" should read --images--.
TABLE 1, "≦ 169 mμ ≧ 947 mμ" should read --≦ 169 mμ/ ≧ 949 mμ--.
Line 64, "cles" should read --cle--.

COLUMN 23

Line 12, "claim 1" should read --claim 1,--.

--

UNITED STATES PATENT AND TRADEMARK OFFICE

CERTIFICATE OF CORRECTION

PATENT NO. : 5,120,631

DATED : June 9, 1992

INVENTOR(S) : MAKOTO KANBAYASHI, ET AL.

It is certified that error appears in the above-identified patent and that said Letters Patent is hereby corrected as shown below:

COLUMN 24

Line 28, "particle" should read --a particle--.
Line 32, "has" should read --have--.

Signed and Sealed this

Twenty-fourth Day of August, 1993

Bruce Lehman

*Attest:*

BRUCE LEHMAN

*Attesting Officer*

*Commissioner of Patents and Trademarks*